US007766398B2

(12) United States Patent
Umino et al.

(10) Patent No.: US 7,766,398 B2
(45) Date of Patent: Aug. 3, 2010

(54) DOOR LOCK SYSTEM

(75) Inventors: Masaaki Umino, Yamanashi (JP); Jun Odahara, Yamanashi (JP)

(73) Assignees: Mitsui Mining & Smelting Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/354,135

(22) Filed: Feb. 15, 2006

(65) Prior Publication Data

US 2006/0191304 A1 Aug. 31, 2006

(30) Foreign Application Priority Data

Feb. 28, 2005 (JP) ..... 2005-053358

(51) Int. Cl.
*E05C 3/06* (2006.01)
*E05C 3/16* (2006.01)

(52) U.S. Cl. ..... 292/216; 292/DIG. 23

(58) Field of Classification Search ..... 292/216, 292/DIG. 23
See application file for complete search history.

(56) References Cited

U.S. PATENT DOCUMENTS 3,596,482 A * 8/1971 Pollak ..... 70/151 R
4,093,289 A * 6/1978 Inabayashi et al. ..... 292/336.3
4,508,379 A * 4/1985 Mochida ..... 292/336.3
4,773,683 A * 9/1988 Nakamura ..... 292/216
5,079,964 A * 1/1992 Hamada et al. ..... 74/89.25
5,676,002 A * 10/1997 Hoeptner, III ..... 70/416
6,059,327 A * 5/2000 Yoshikuwa ..... 292/216
6,415,636 B1 * 7/2002 Fukumoto et al. ..... 70/208
7,171,832 B2 * 2/2007 Umino ..... 70/472

FOREIGN PATENT DOCUMENTS

JP 2004-197377 A 7/2004
JP 2004-332449 A 11/2004
JP 2004-346542 A 12/2004

* cited by examiner

*Primary Examiner*—Carlos Lugo
(74) *Attorney, Agent, or Firm*—Foley & Lardner LLP

(57) ABSTRACT

A door lock system for vehicle doors includes a lock mechanism including a switching lever. The switching lever can be moved freely between a neutral position and a locking position and between the neutral position and an unlocking position. The door can not be opened when the switching lever is moved from the neutral position to the locking position and can be opened when the switching lever is moved from the neutral position to the unlocking position. A link unit that receives a lever operation force from outside of the door and conveys the lever operation force to the switching lever. A holding unit holds the switching lever at the neutral position when the link unit does not receive the lever operation force.

1 Claim, 9 Drawing Sheets

DOOR LOCK SYSTEM

BACKGROUND OF THE INVENTION

1. Field of the Invention

The present invention relates to a door lock system applicable to generally vehicles.

2. Description of the Related Art

As a door lock system to be applied to vehicles such as a four-wheeled vehicle, there is one including a link unit such as a torque cable that links a lock mechanism provided in the door and a key cylinder to each other. The lock mechanism is switched between an unlocked state that allows a door opening movement when an outside handle is operated to open the door, and a locked state that maintains the door being closed, even if the outside handle is operated to open the door, by making ineffective the door opening operation of the outside handle. The key cylinder is for key operations from the outside of the vehicle, and is provided on a door outer panel. In this key cylinder, a cylinder returning spring that keeps a normal position when a key operation is not performed is provided.

In this door lock system, when the key cylinder is rotated against an elastic force of the cylinder returning spring in response to a key operation, this rotating force is transmitted to a switching lever of the lock mechanism through the link unit to turn the switching lever from a neutral position to a switching position and switch the lock mechanism to an unlocked state or a locked state. When the key operation force is removed, the key cylinder is returned to the normal position by the cylinder returning spring and the switching lever is returned to the neutral position through the link unit.

A conventional door lock system has been disclosed, for example, in Japanese Published Unexamined Patent Application No. 2004-332449.

According to the conventional door lock system, the key cylinder can be provided on the door panel without depending on the position of the lock mechanism, thereby increasing degree of freedom of design and layout. However, sometimes, the relative positional relationship between the lock mechanism and the key cylinder influences the power transmission efficiency of the link unit. For example, when a torque cable is used as the link unit, although the key cylinder position with respect to the lock mechanism can be arbitrarily set by greatly bending the torque cable, lowering in power transmission efficiency is unavoidable.

In such a state with lowered power transmission efficiency, even when the cylinder returning spring returns the key cylinder to the normal position, the switching lever does not always return to the neutral position from the switching position. As a result, the lock mechanism may not be correctly switched by a successive key operation. This problem may occur not only when the torque cable is used but also when the key cylinder and the lock mechanism are linked via a link unit.

SUMMARY OF THE INVENTION

It is an object of the present invention to at least solve the problems in the conventional technology.

According to an aspect of the present invention, a door lock system includes a door handle operable from outside of a door for opening/closing the door; a lock mechanism including a switching lever, the switching lever capable of moving freely between a neutral position and a locking position and between the neutral position and an unlocking position, wherein the lock mechanism configured to prevent opening of the door by operation of the door handle when the switching lever is moved from the neutral position to the locking position, and allows opening of the door by operation of the door handle when the switching lever is moved from the neutral position to the unlocking position; a link unit that receives a lever operation force from outside of the door and conveys the lever operation force to the switching lever of the lock mechanism to thereby moving the switching lever between the neutral position and the locking position and between the neutral position and the unlocking position; and a holding unit that holds the switching lever at the neutral position when the link unit does not receive the lever operation force.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below in detail with reference to the accompanying drawings.

Figure 1:
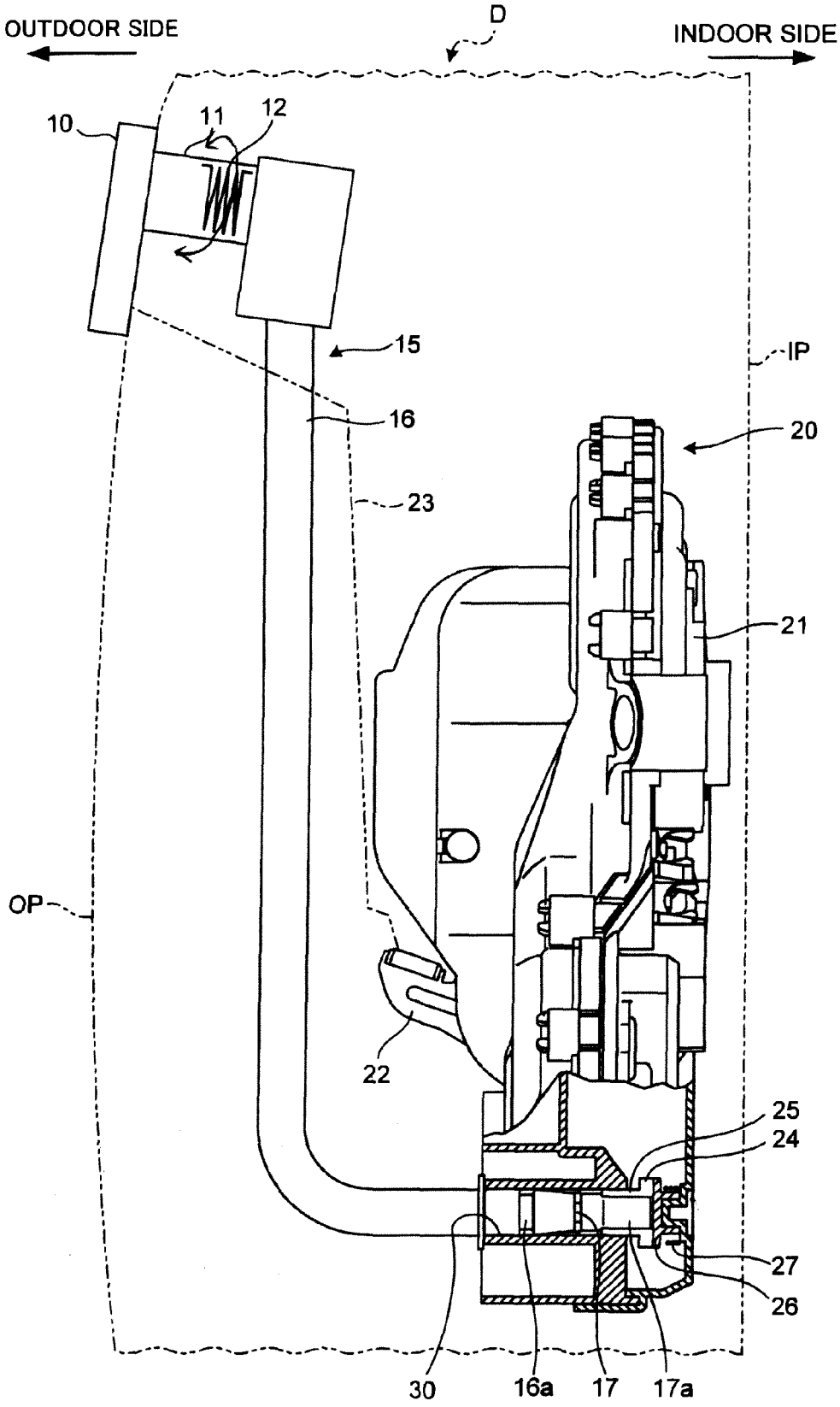
FIG. 1 is a conceptual diagram of a door to which the door lock system of according to an embodiment of the present invention is applied, viewed from the front side of the vehicle.

FIG. 1 is a conceptual diagram of relevant parts of a door lock system according to an embodiment of the invention. The door lock system is applied is applied to a vehicle door. FIG. 1 depicts a side door (door D on the driver seat side in a vehicle with a right hand steering wheel) with a hinge on its front side, disposed on the right of the front seat of a four-wheeled vehicle. The door D of this vehicle has a latch mechanism in the same manner as in a conventional door although this is not clearly shown in the drawings. The latch mechanism maintains the door D being closed with respect to the vehicle main body B when the latch mechanism engages with a striker (not shown) provided in the vehicle main body B, and allows the door D to be moved to open with respect to the vehicle main body B when the engagement with the striker is released. As shown in FIG. 1, this door D has an outside handle (door handle)-10 and a lock mechanism 20.

Figure 2:
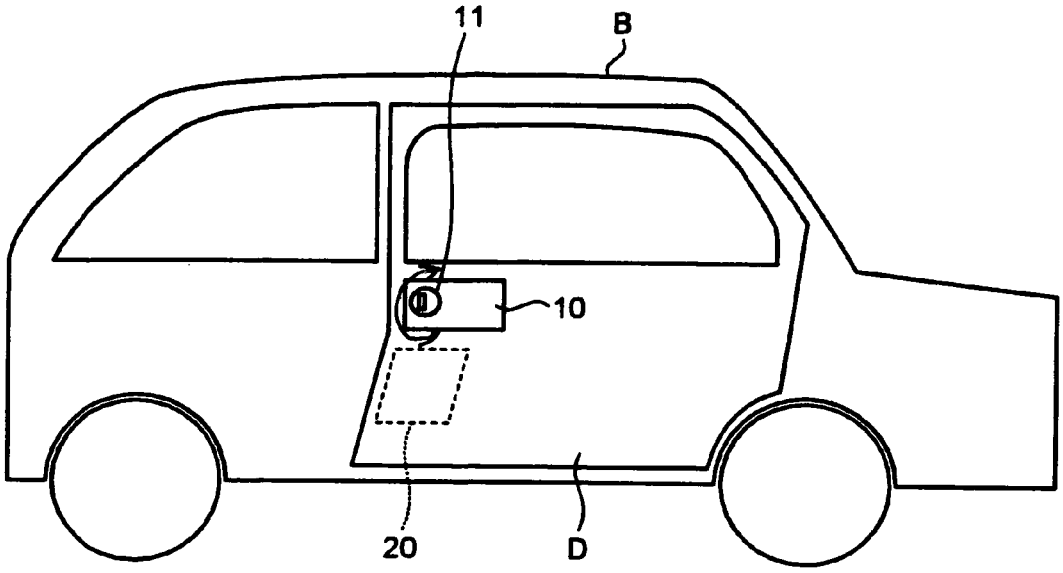
FIG. 2 is a conceptual diagram of a vehicle to which the door lock system.

The outside handle 10 is an operating member that operates the door D to open when the door D is moved to open from the vehicle main body B, and is provided on the door outer panel OP positioned on the outdoor side. A key cylinder 11 is attached to this outside handle 10. The key cylinder 11 becomes rotatable when a key that fits the key cylinder is inserted from the outside of the vehicle main body B, and is provided on the door outer panel OP while a key hole is exposed to the outside. The rotational motion of the key cylinder is indicated by rotation lines as shown in FIGS. 1 and 2. In this key cylinder 11, a cylinder returning spring 12 that keeps the key cylinder at a normal position when no key operation is performed is provided. The cylinder returning spring 12 applied in this embodiment has a spring constant set smaller than that of a normal key cylinder 11.

To the key cylinder 11, a torque cable (link unit) 15 is connected. The torque cable 15 is formed by housing an inner cable 17 inside an outer tube 16 so as to rotate, and when the key cylinder 11 rotates, the inner cable 17 rotates in the same direction with respect to the outer tube 16. At an extending end of this torque cable 15, an engaging portion 16*a* is formed in the outer tube 16, and an engaging piece 17*a* is provided on the inner cable 17. The engaging portion 16*a* is an annular concavity formed in the outer circumference of the outer tube 16. The engaging piece 17*a* is a plate-shaped portion, and is continued from the inner cable 17 so as to interlock with the rotation of the inner cable 17.

The lock mechanism 20 is interposed between the outside handle 10 and the latch mechanism, and is disposed inside the door D, that is, between the door outer panel OP and the door inner panel IP positioned on the indoor side while being housed in the housing 21. In the lock mechanism 20, at a portion to be exposed to the outside of the housing 21, an open lever 22 is provided. The open lever 22 serves as an input unit that inputs a door opening operation of the outside handle 10, and is disposed so as to turn around the center of axle extending horizontally along the front and rear direction of the vehicle main body B. The open lever 22 is linked to the outside handle 10 by a link mechanism 23 so as to turn downward when the outside handle 10 is operated to open the door.

In the lock mechanism 20, as shown in FIG. 3 through FIG. 6, a switching lever 24 is disposed inside the housing 21. The switching lever 24 extends outward radially from the circumferential surface of a columnar lever shaft 25, and is supported on the housing 21 via both ends of the lever shaft 25 so as to turn around the center of axle of the lever shaft 25. This switching lever 24 switches the lock mechanism 20 into an unlocked state when turning from the neutral position shown in FIG. 3 to the unlocking position shown in FIG. 5, and switches the lock mechanism 20 into a locked state when turning from the neutral position shown in FIG. 3 to the locking position shown in FIG. 6.

In an unlocked state of the lock mechanism 20, when the open lever 22 turns downward according to a door opening operation of the outside handle 10, this turning of the open lever 22 is transmitted to the latch mechanism and releases the latch mechanism. Therefore, even when the latch mechanism engages with the striker, the door opening operation of the outside handle 10 releases this engagement and can move the door D to open.

On the other hand, in a locked state of the lock mechanism 20, even when the open lever 22 turns downward according to a door opening operation of the outside handle 10, this turning of the open lever 22 is made ineffective and is not transmitted to the latch mechanism, and the latch mechanism is not released. Therefore, in the state in that the latch mechanism engages with the striker, this engagement is not released by the door opening operation of the outside handle 10, and the door D is maintained as being closed.

Figure 4:
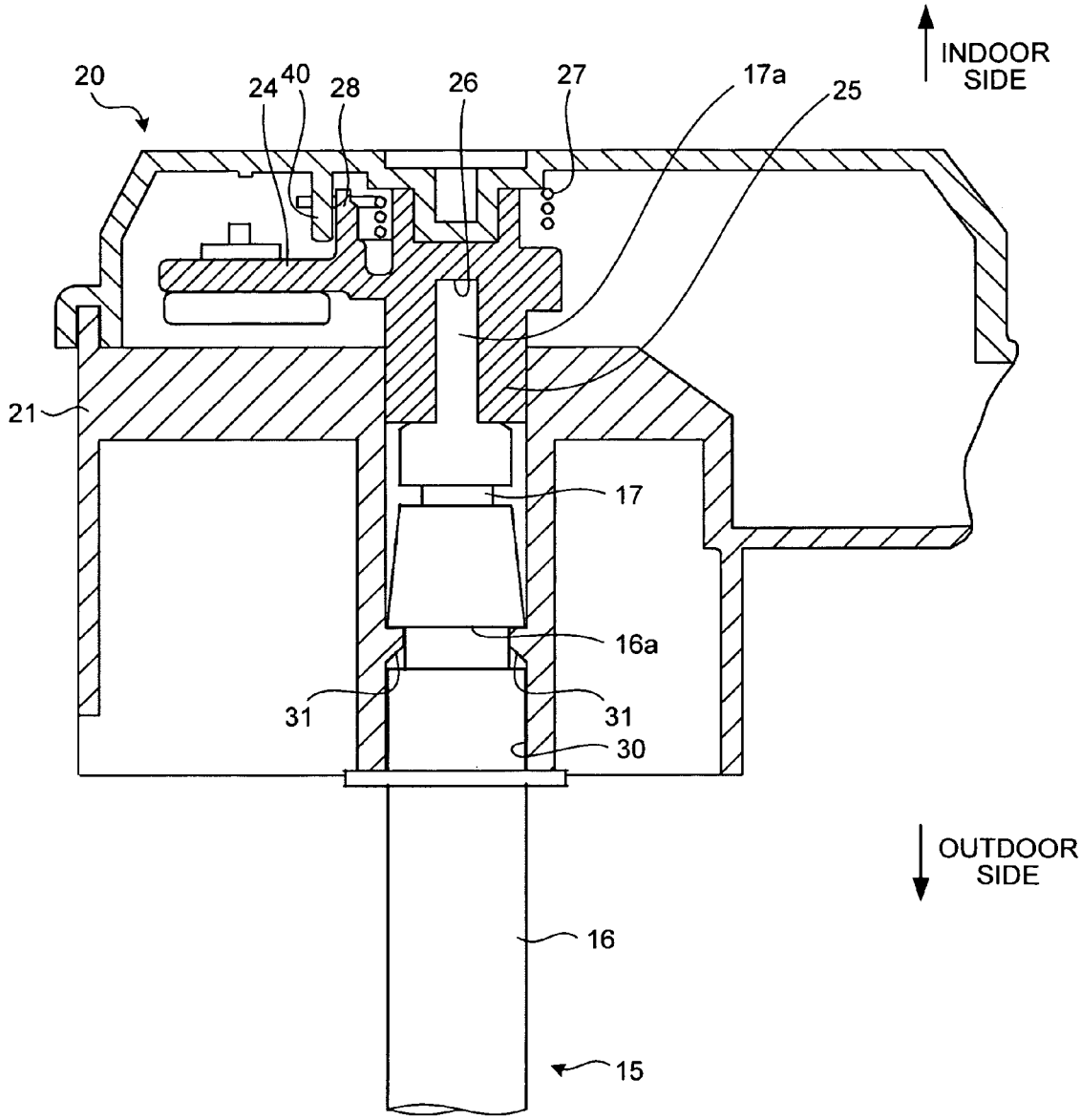
FIG. 4 is a sectional view along the line IV-IV shown in FIG. 3.

As seen in FIG. 4, this switching lever 24 has an engaging groove 26, a lever returning spring 27, and a spring working piece 28. The engaging groove 26 is a slit-shaped notch formed from the end face of the lever shaft 25 extending to the outdoor side. In this engaging groove 26, the engaging piece 17*a* of the torque cable 15 fits through a cylindrical hole 30 formed in the housing 21. The cylindrical hole 30 of the housing 21 has a cylindrical shape with an inner diameter that is capable of housing the outer tube 16 of the torque cable 15. On the inner circumferential surface of this cylindrical hole 30, a claw piece 31 that engages with the engaging portion 16*a* of the outer tube 16 and prevents the outer tube 16 from slipping off the cylindrical hole 30 when the engaging piece 17*a* of the inner cable 17 fits the engaging groove 26 of the switching lever 24 is provided.

The lever returning spring 27 is a coil spring formed by spirally winding a middle portion of an elastic wire member and projecting both ends outward radially, and is disposed between the switching lever 24 and the housing 21 while the middle portion is disposed around the lever shaft 25 and both ends are press-engaged with a spring engaging piece 40 of the housing 21. The spring engaging piece 40 of the housing 21 is an arc-shaped protrusion formed at a position to be covered by the switching lever 24 when the switching lever 24 is at the neutral position. This lever returning spring 27 has a spring constant set smaller than that of the cylinder returning spring 12 of the key cylinder 11.

The spring working piece 28 is a projection provided from the end face on the indoor side of the switching lever 24 toward the housing 21. This spring working piece 28 is disposed so as to project between two ends of the lever returning spring 27 on the side closer to the lever shaft 25 than the spring engaging piece 40 of the housing 21 when the switching lever 24 is at the neutral position.

Figure 3:
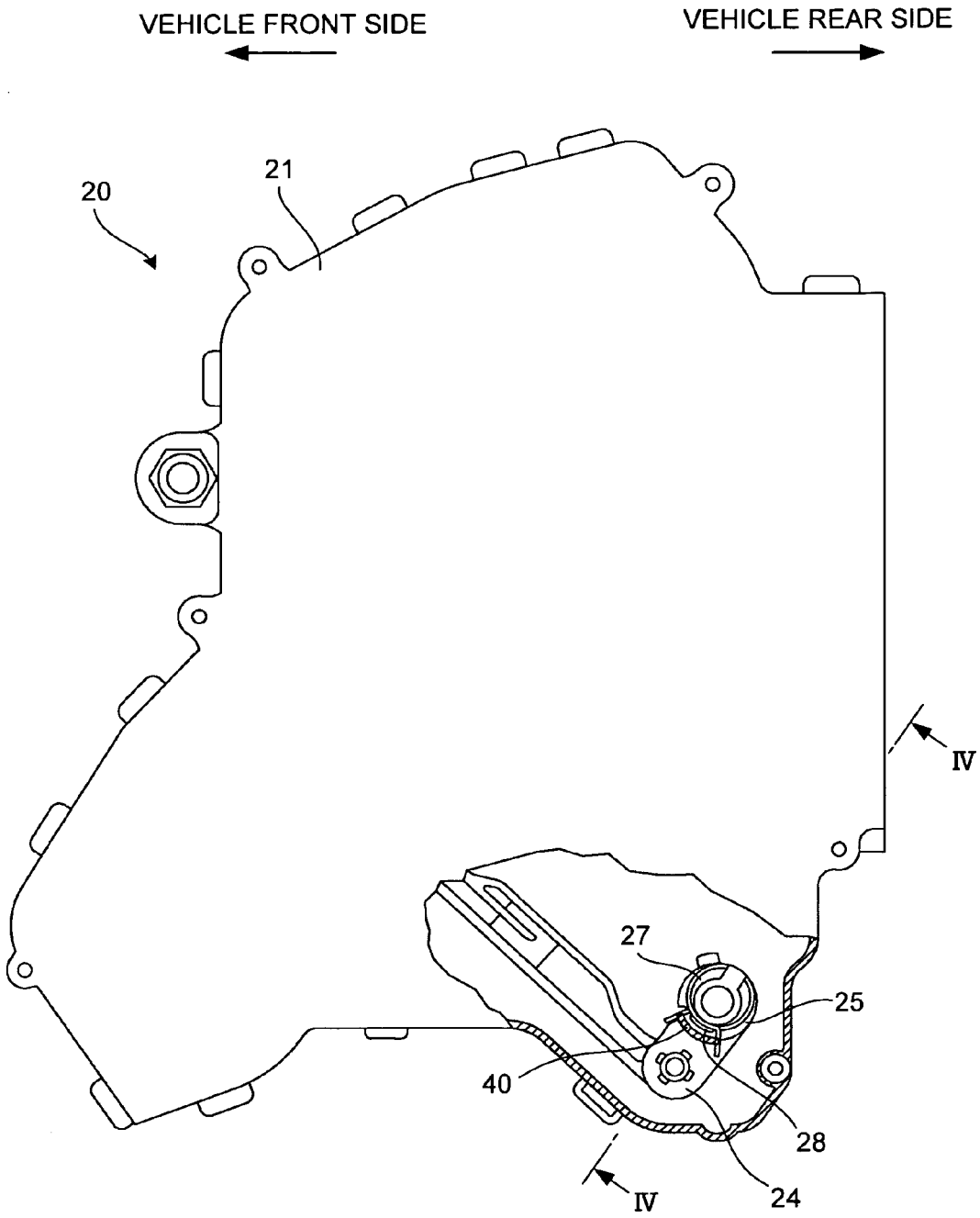
FIG. 3 is a conceptual diagram of the door lock system viewed from the indoor side.
Figure 5:
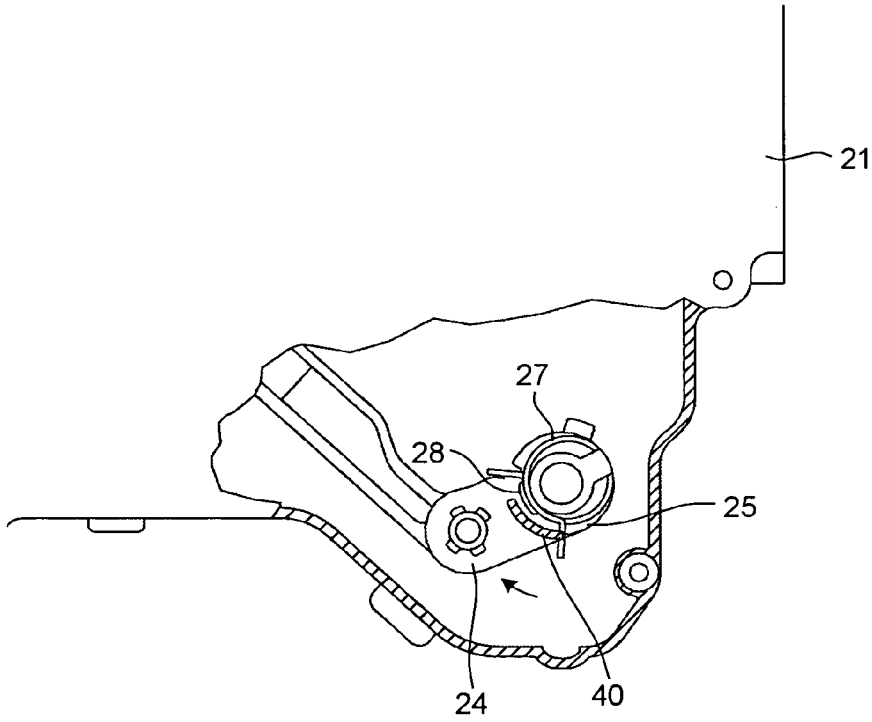
FIG. 5 is a conceptual diagram of a turned state of a switching lever of the door lock system.
Figure 6:
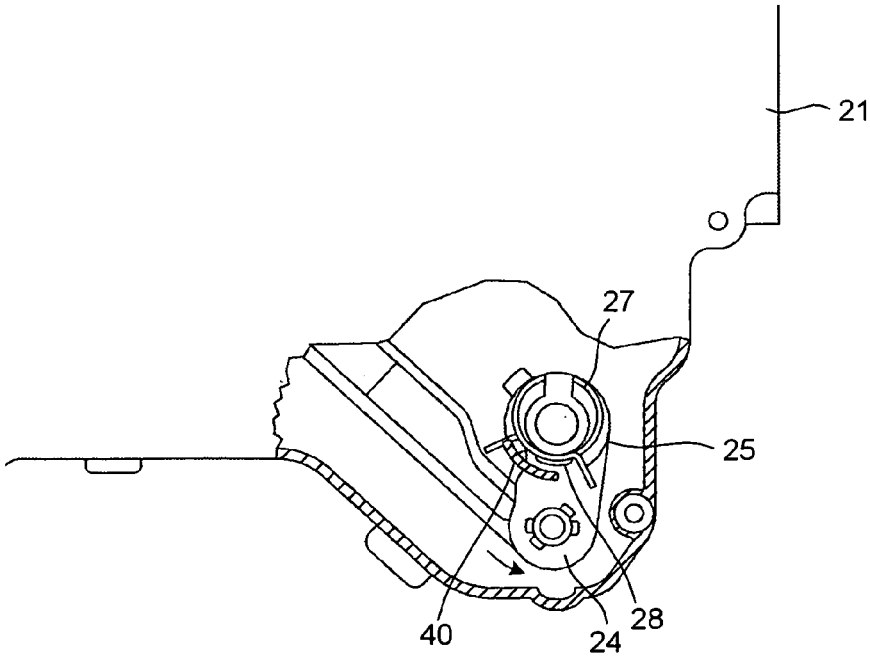
FIG. 6 is a conceptual diagram of a turned state of the switching lever.

When the lever returning spring 27 is at the neutral position, as shown in FIG. 3, the spring working piece 28 is at a position apart from the two ends of the lever returning spring 27. When the switching lever 24 is made to turn to the locking position or the unlocking position from this state by applying an external force, as shown in FIG. 5 and FIG. 6, the spring working piece 28 engages with the end of the lever returning spring 27 and moves against the elastic force of the lever returning spring 27. Therefore, by removing the external force on the lever returning spring 27, the switching lever 24 returns to the neutral position due to the elastic returning force of the lever returning spring 27.

Figure 7:
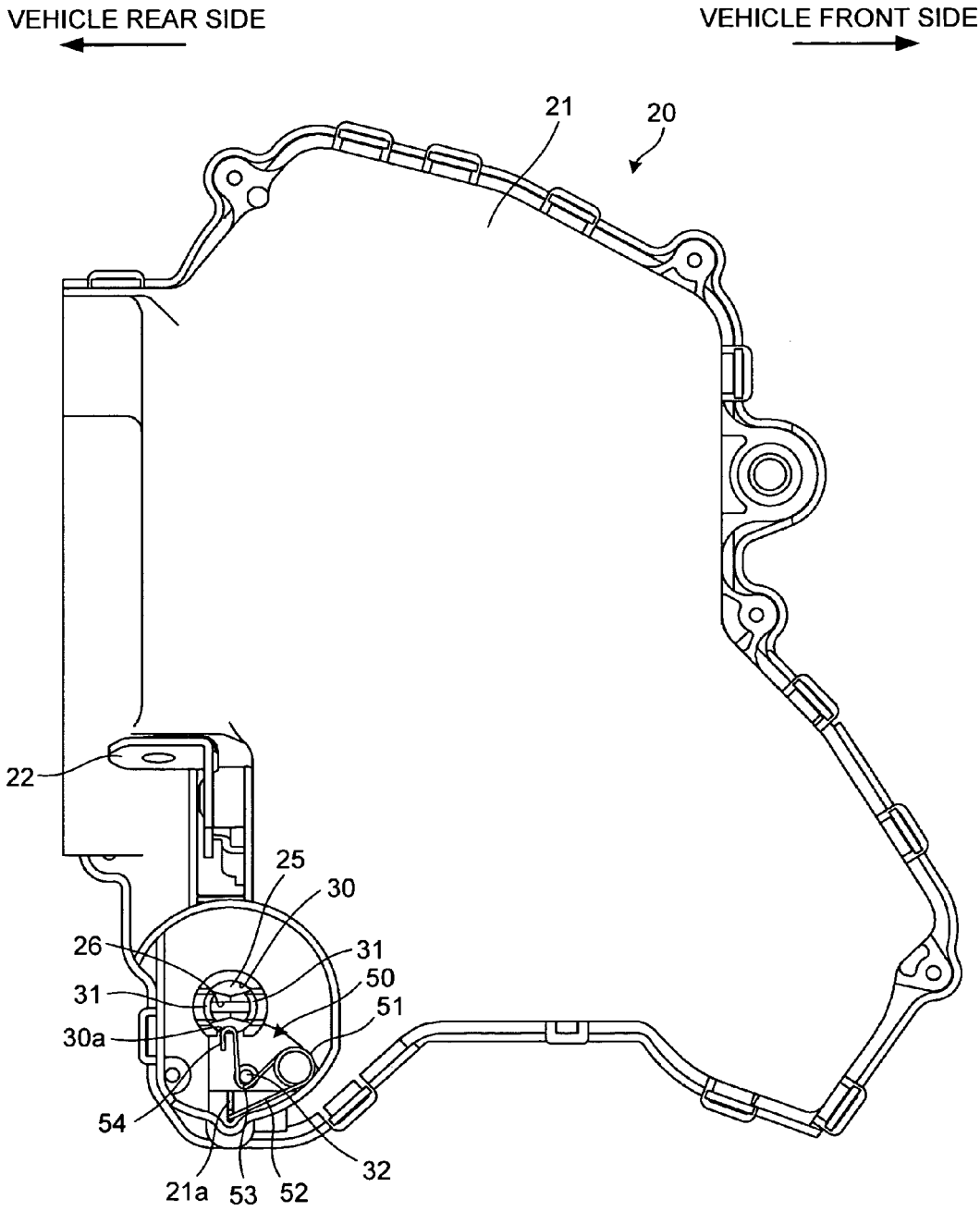
FIG. 7 is a conceptual diagram of the door lock system viewed from the outdoor side.
Figure 8:
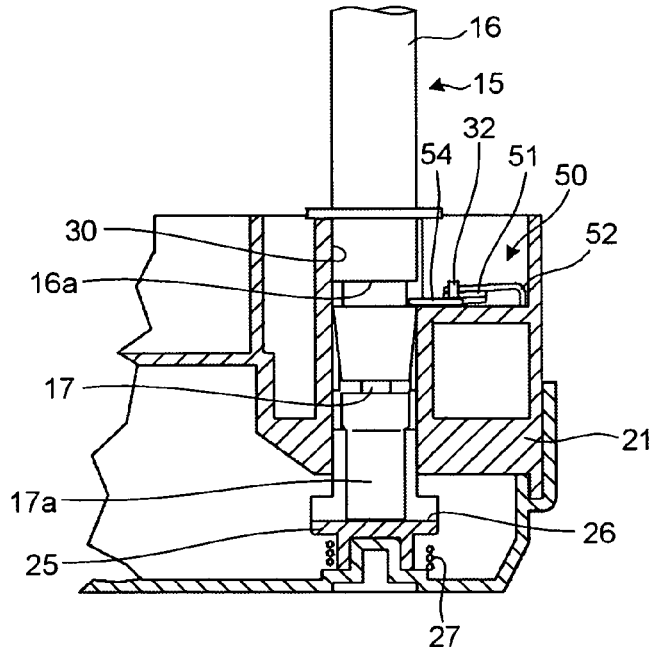
FIG. 8 is a sectional side view of a linking state between the door lock system and a link unit.

Furthermore, the door lock system includes a shutter spring 50 around the cylindrical hole 30 of the housing 21. The shutter spring 50 is constructed by appropriately molding an elastic wire member as shown in FIG. 7, and has a winding portion 51, a supporting portion 52, a latching portion 53, and an arresting portion 54. The winding portion 51 is formed by winding the elastic wire member by a plurality of turns. The supporting portion 52 is inserted in the slit 21*a* of the housing 21 after extending outward radially from the winding portion 51. The latching portion 53 is bent to separate from the supporting portion 52 after extending outward radially from the winding portion 51. The arresting portion 54 is curved at the extending end of the latching portion 53. This shutter spring 50 is attached between the circumferential wall of the housing 21 and a stopper projection 32 provided around the cylindrical hole 30 while the latching portion 53 is made proximal to the supporting portion 52 in an elastic manner. In this state, as shown in FIG. 8, the arresting portion 54 of the shutter spring

50 projects inward from the notch 30*a* of the cylindrical hole 30 at the same height as the claw piece 31 of the cylindrical hole 30 and engages with the engaging portion 16*a* of the outer tube 16.

In the door lock system constructed as described above, when the key cylinder 11 is rotated by a key operation, this rotating force is transmitted to the switching lever 24 of the lock mechanism 20 through the torque cable 15 and turns the switching lever 24 from the neutral position to the unlocking position or the locking position, whereby the lock mechanism 20 is switched to an unlocked state or a locked state.

On the other hand, when the key operation force is removed, the key cylinder 11 is returned to the normal position by the cylinder returning spring 12. Furthermore, not only is the returning movement of the key cylinder 11 transmitted to the switching lever 24 through the torque cable 15, but also the switching lever 24 is returned to the neutral position by the lever returning spring 27.

As a result, even when the torque cable 15 is curved to increase the degree of freedom of design and layout and the power transmission efficiency is much lower than 100%, the switching lever 24 always reliably returns to the neutral position, so that the lock mechanism 20 can be correctly switched by a successive key operation.

In the door lock system including the lock mechanism 20 housed inside the housing 21 as described above, when the torque cable 15 is pulled out of the housing 21, the switching lever 24 is exposed to the outside through the cylindrical hole 30, and if this switching lever 24 is directly operated, the lock mechanism 20 may become capable of switching to an unlocked state.

Figure 9:
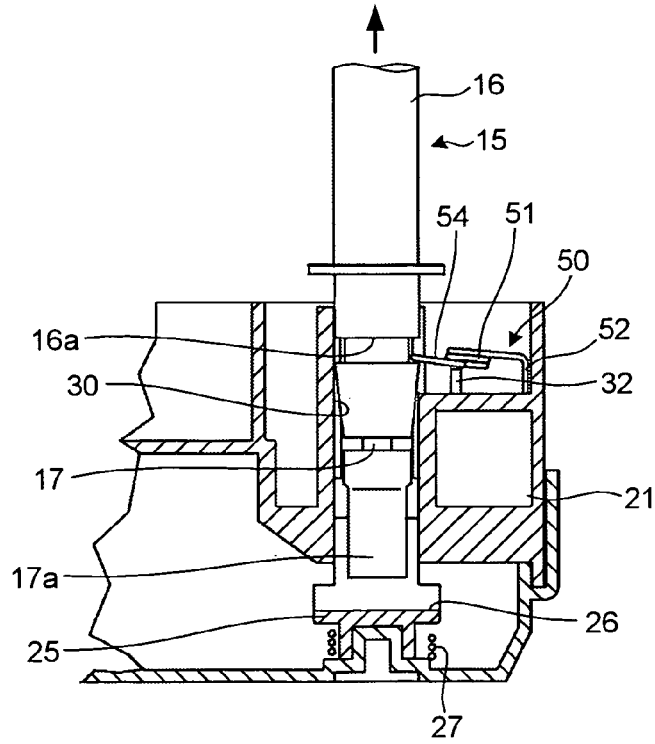
FIG. 9 is a sectional side view of an intermediate dropped state of the link unit from the state of FIG. 8.
Figure 10:
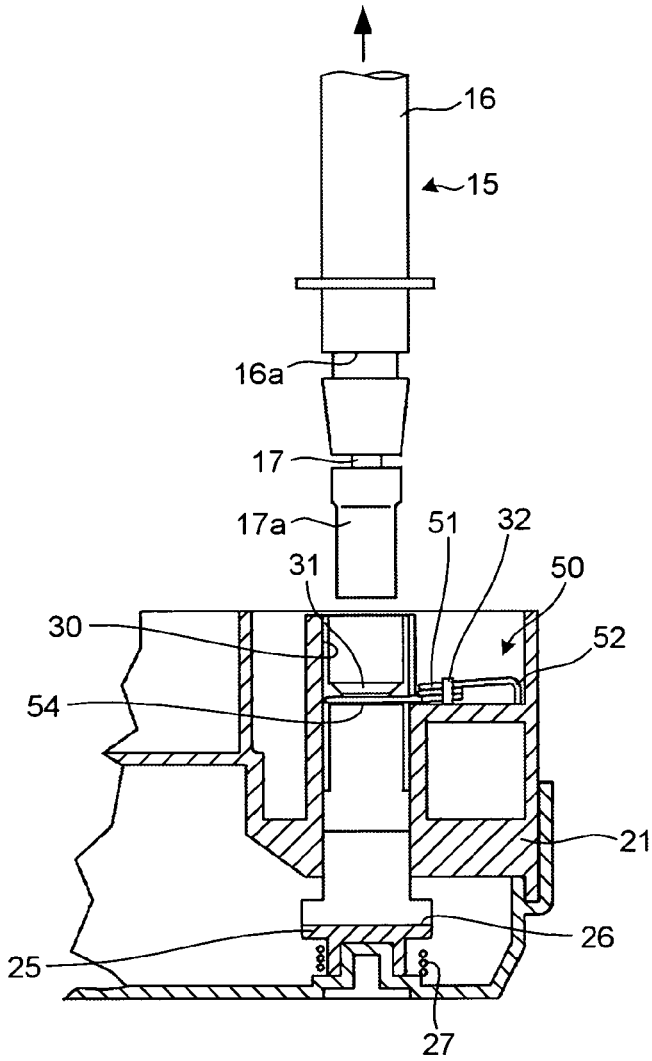
FIG. 10 is a sectional side view of a completely dropped state of the link unit from the state of FIG. 9.
Figure 11:
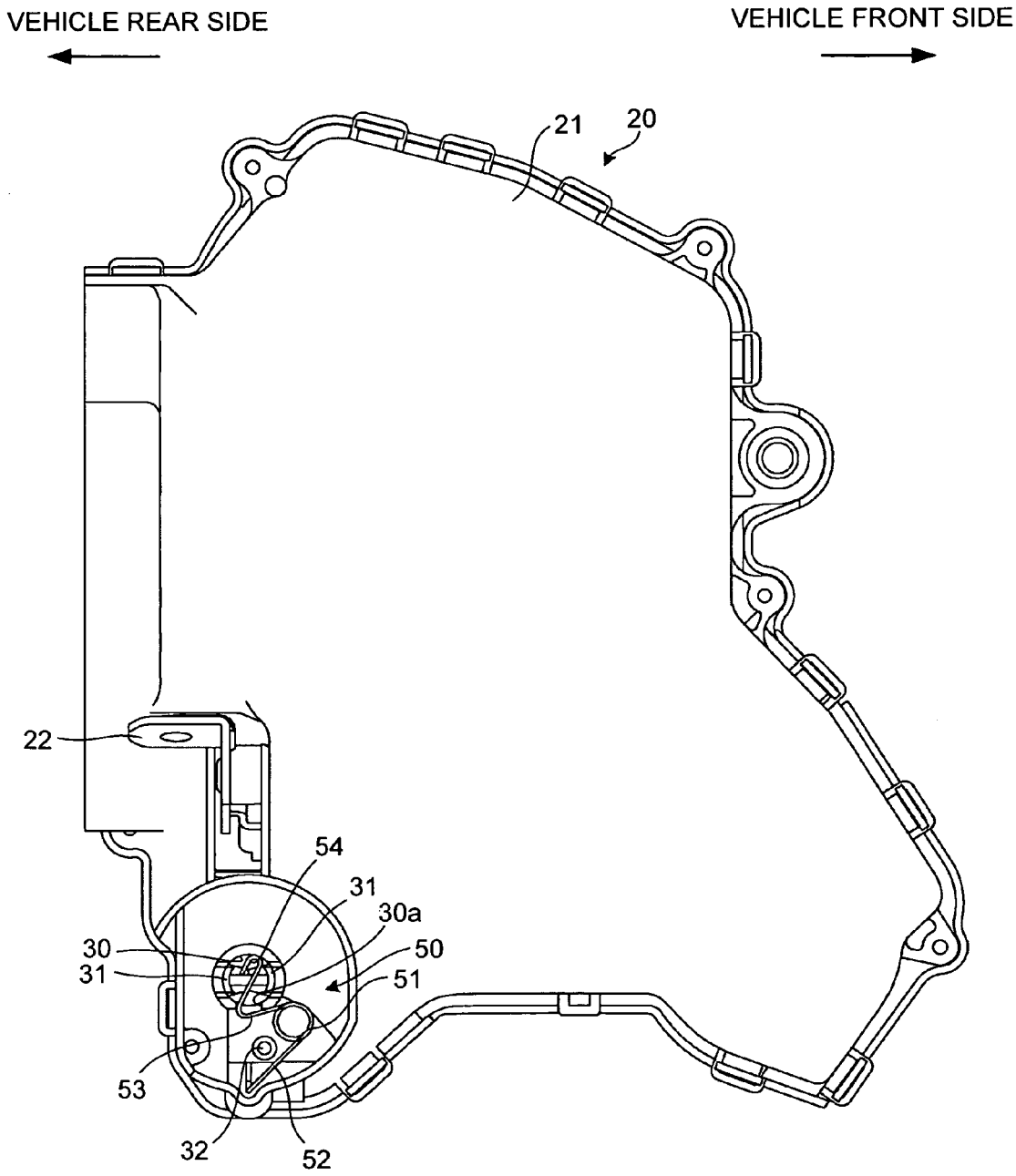
FIG. 11 is a conceptual diagram of the door lock system viewed from the outdoor side.

However, according to the door lock system described above, when the torque cable 15 is pulled out, the arresting portion 54 of the shutter spring 50 projects to the inside of the cylindrical hole 30 and effectively prevents the switching lever 24 from being directly operated. Namely, when the torque cable 15 is pulled out from the state of FIG. 8, as shown in FIG. 9, the arresting portion 54 fitting the engaging portion 16*a* of the outer tube 16 moves together with the torque cable 15, and the engagement between the latching portion 53 and the stopper projection 32 is released soon. Thereafter, when the torque cable 15 is completely pulled out, as shown in FIG. 10 and FIG. 11, the arresting portion 54 projects to the inside through the notch 30*a* of the cylindrical hole 30 due to the elastic force of the shutter spring 50, and maintains this state. Therefore, even if a malicious person tries to directly operate the switching lever 24 through the cylindrical hole 30, this can be prevented, and the theftproof performance of the vehicle main body B to which the invention is applied can be improved.

In addition, when the door lock system is assembled, by inserting the outer tube 16 into the cylindrical hole 30 from the state of FIG. 7 and FIG. 8, the arresting portion 54 of the shutter spring 50 temporarily elastically withdraws from the cylindrical hole 30 and then automatically fits the engaging portion 16*a*, and this does not deteriorate the assembling workability at all.

According to the invention, a normal state holding unit reliably returns the switching lever to the neutral position when a key operation force is removed. Therefore, the lock mechanism can be correctly switched by a successive key operation.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2005-053358, filed Feb. 28, 2005, which is incorporated herein by reference in its entirety.

What is claimed is:

1. A door lock system comprising:

a door handle disposed and operable from outside of a door for opening/closing the door;

a lock mechanism including a switching lever, the switching lever capable of moving between a neutral position and a locking position and between the neutral position and an unlocking position, wherein the lock mechanism is configured to prevent opening of the door by operation of the door handle when the switching lever is moved from the neutral position to the locking position, and allows opening of the door by operation of the door handle when the switching lever is moved from the neutral position to the unlocking position;

a key cylinder that is disposed on the door handle and that rotates according to a key operation and includes a cylinder returning spring that keeps the key cylinder at a normal position when no key operation is performed;

a link unit that receives a key operation force when the key cylinder is rotated according to the key operation and conveys the key operation force to the switching lever of the lock mechanism to thereby move the switching lever between the neutral position and the locking position and between the neutral position and the unlocking position;

a holding unit that biases the switching lever to the neutral position when the link unit does not receive the key operation force; and a housing for housing the switching lever, wherein the holding unit is a lever returning spring interposed between the housing and the switching lever, the link unit is a torque cable interposed between the key cylinder and the switching lever, and the lever returning spring has a spring constant that is smaller than that of the cylinder returning spring in the key cylinder, wherein the switching lever comprises a spring working piece that engages with the lever returning spring when the lever returning spring has been moved to the locking position or the unlocking position.

* * * * *